United States Patent [19]

Heitbrink

[11] 4,144,868

[45] Mar. 20, 1979

[54] CHISEL FOR AN IMPACT APPARATUS

[76] Inventor: Hermanus A. Heitbrink, Kampioenstraat 11, Enschede, Netherlands

[21] Appl. No.: 812,694

[22] Filed: Jul. 5, 1977

[30] Foreign Application Priority Data

Jul. 6, 1976 [NL] Netherlands ..... 7607465

[51] Int. Cl.[2] ..... B28D 1/26

[52] U.S. Cl. ..... 125/41; 30/168

[58] Field of Search ..... 125/40, 41; 30/168

[56] References Cited

U.S. PATENT DOCUMENTS

| | | | |
|---|---|---|---|
| 523,095 | 7/1894 | Young | 125/40 |
| 1,350,241 | 8/1920 | Routh | 30/168 |

*Primary Examiner*—Harold D. Whitehead

*Attorney, Agent, or Firm*—Diller, Ramik & Wight

[57] ABSTRACT

Chisel for an impact apparatus comprising a stem with connecting means, in line with said stem a blade-shaped, longitudinal chisel part, the free end of which is provided with a plurality of teeth which are thicker than the blade-shaped part. Extending from between the teeth either straight or undulated grooves are arranged in the blade-shaped part.

9 Claims, 5 Drawing Figures

3
2
1
5
8
7
6

2
3
1
d
5
8
7
D 5
10
7

5
8
9

11
12
13
7
6

CHISEL FOR AN IMPACT APPARATUS

The invention relates to a chisel for an impact apparatus, provided with a stem having connecting means and in line with the said stem a longitudinal blade-shaped chisel part. A chisel of the kind as disclosed is normally used for destructively removing material from buildings and roads and is used in a pneumatically or electrically driven impact hammer. This kind of chisel has one blunt bit extending widthwise of the blade shaped part. The chisel is under the influence of strokes and acts like a wedge forced between material layers or rammed into the material itself, such that material can be broken away.

The invention relates to an improved chisel of the kind disclosed, being particularly suited for removing joints from between stones or bricks in a masonry structure. The chisels of the invention are characterized in that the free end of the chisel part is provided with a plurality of teeth, the thickness of the blade shaped part being less than the dimension of the teeth in the direction of the thickness and longitudinal grooves being arranged in the blade-shaped part extending from between the teeth. Such chisels allow removal of undamaged stones and bricks from walls by removing the mortar from the joints Preferably the teeth are formed by parallel hard-metal platelets extending transverse to the blade-shaped chisel part. In a preferred embodiment the said platelets extend from the teeth to the vincinity of the stem. Particularly the vertical angles of this platelets are obtuse, such that the impact forces mainly work on the material of the joints and not on the stones or bricks between which the joint is sandwiched. For working wet material the platelets preferably have a concave free end, in particular a swallow trail shape with an obtuse contained angle. Accordingly these teeth are each having two bits, one on each side of the tooth.

In a very practical embodiment the longitudinal grooves extend from the teeth to the vincinity of the stem. The said grooves may be both straight and undulated in the plane of the blade shaped part. For improving the discharge of loose material the bottoms of the grooves may be sawtooth shaped, with an abrupt decline and a gradual incline, seen from the teeth.

The invention will be exemplified in the following description of some preferred embodiments being depicted in the drawings.

Figure 1:
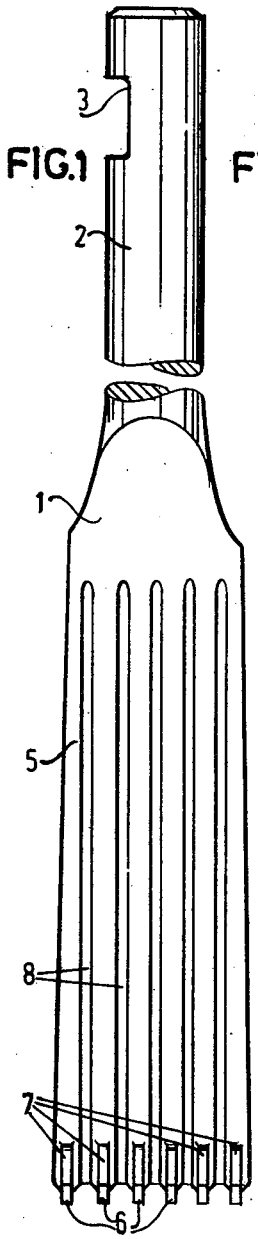
FIG. 1 shows a view of a chisel of the invention.
Figure 2:
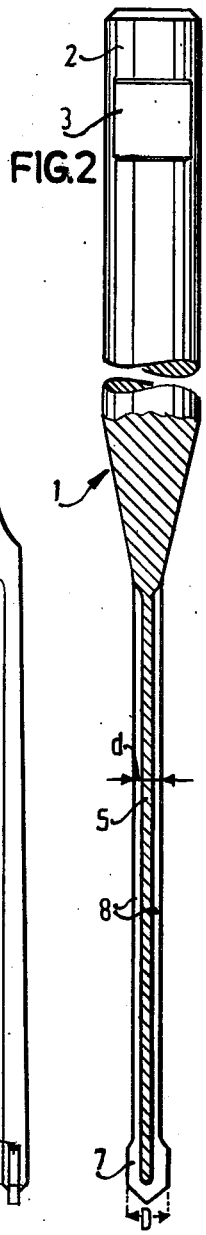
FIG. 2 shows a partial sectioned side view of the chisel shown in FIG. 1.

The impact chisel 1 as shown in FIG. 1 and in FIG. 2 comprises a cylindrical stem 2 having connecting means 3 and a blade-shaped chisel part 5. This chisel part 5 is wider than the stem 2 and its thickness will be dependent on the proposed use. For example, for removing the mortar from joints in masonry the blade thickness will be normally in the order of several millimeters.

The free end of the chisel part 5 is provided with a plurality of teeth 6, the dimension D in the direction of the thickness d of the blade shaped chisel part 5 being in excess of the said thickness d. The points of the teeth 6 are formed by platelets 7 of hard metal, extending transversely to the blade shaped chisel part 5. Said platelets 7 as shown in FIG. 2 are roof shaped, having an obtuse vertical angle being in the order of 100°.

FIG. 2 also shows that longitudinal grooves 8 are extending from between the teeth across almost the entire blade-shaped part.

Figure 3:
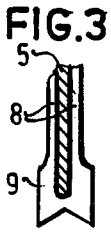
FIG. 3 shows a partial longitudinal section similar to FIG. 2 of a modified embodiment.

FIG. 3 shows an alternative embodiment of the hard-metal platelets for forming the teeth. These platelets are swallow tail shaped with an obtuse contained angle. In this embodiment each tooth has two bits, one on each side of the tooth.

Figure 4:
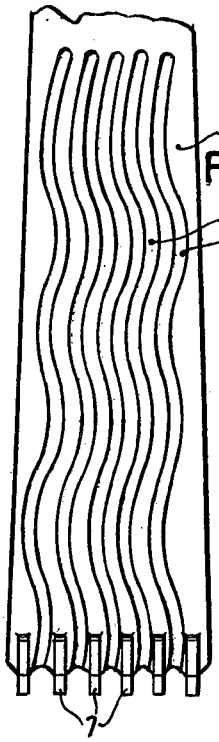
FIG. 4 shows a view of a chisel blade in a still modified embodiment having undulated grooves.

FIG. 4 shows a detail of another modified embodiment of the chisel of the invention. The grooves 10 in the blade-shaped part 5 undulated in the plane of the blade-shaped part.

Figure 5:
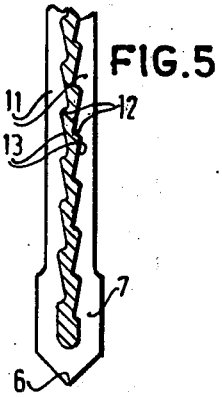
FIG. 5 shows a partial longitudinal section of a further modified embodiment having grooves with undulated bottoms.

FIG. 5 shows a detail of still another embodiment of a chisel in longitudinal section. The bottom of the groove 11 is undulated, the undulation being such that seen from the tooth 6 the bottom shows a sharp decline 12 and thereafter a gradual incline 13, this sequence being repeated several times. This embodiment is particularly well suited for increasing the discharge rate of loosened material through the grooves 11.

What I claim is:

1. A chisel for impact apparatus, said chisel being of elongate form and presenting a stem at one end adapted to be attached to an impact apparatus, and a blade portion joined to said stem and projecting longitudinally therefrom to define the opposite end of the chisel, and said blade portion terminating in a transverse edge; a plurality of teeth disposed in spaced relation to each other along said transverse edge, each tooth being disposed in a plane extending longitudinally of said blade portion and perpendicular thereto, each tooth being of a width greater than the thickness of said blade portion and extending beyond said transverse edge to terminate in at least one bit; and said blade portion including a plurality of longitudinally extending grooves, each groove extending from said transverse edge between an adjacent pair of said teeth.

2. Chisel according to claim 1, wherein the teeth are formed by parallel hard-metal platelets.

3. Chisel according to claim 1, wherein the longitudinal grooves extend from the teeth to the vincinity of the stem.

4. Chisel according to claim 2, wherein the platelets are roof shaped, the ridges of which are aligned.

5. Chisel according to claim 4, wherein the platelets have an obtuse vertical angle.

6. Chisel according to claim 2, wherein the platelets having a concave free end.

7. Chisel according to claim 1, wherein the bottoms of the grooves are saw tooth shaped.

8. Chisel according to claim 7, wherein the bottoms of the grooves have an abrupt decline and an gradual incline seen from the teeth.

9. Chisel according to claim 6, wherein the platelets are swallow tail shaped.

* * * * *